United States Patent [19]

Manyk

[11] Patent Number: 4,798,380

[45] Date of Patent: Jan. 17, 1989

[54] STOWABLE EXERCISING APPARATUS

[76] Inventor: Edward Manyk, C55-Padgett Rd., Powell River, British Columbia V8A 4Z2, Canada

[21] Appl. No.: 63,209

[22] Filed: Jun. 16, 1987

[51] Int. Cl.[4] ..... A63B 23/00

[52] U.S. Cl. ..... 272/93; 272/900

[58] Field of Search ..... 272/93, 144, 900, 73, 272/130, 138, 139; 128/25 R; 5/508, 507, 503, 60; 248/286, 293

[56] References Cited

U.S. PATENT DOCUMENTS

| | | | |
|---|---|---|---|
| 837,642 | 12/1906 | Powell | 248/293 |
| 1,862,237 | 6/1932 | Pepler | 5/507 |
| 2,709,818 | 6/1955 | Freese | 5/507 |
| 3,077,613 | 2/1963 | Mayer | 272/900 |
| 3,497,882 | 3/1970 | Weeks | 272/93 |

FOREIGN PATENT DOCUMENTS

| | | | |
|---|---|---|---|
| 680709 | 2/1964 | Canada | 5/507 |

*Primary Examiner*—Richard J. Apley
*Assistant Examiner*—S. R. Crow
*Attorney, Agent, or Firm*—Townsend & Townsend

[57] ABSTRACT

A stowable exercising apparatus adapted to be mounted to the metal frame of a bed, comprising a means for securing said apparatus to said bed frame, a means for moveably supporting said apparatus to said securing means and exercising means mounted to said support means and adapted to be movable from a vertical operating position along said bed to an horizontal resting position under said bed.

7 Claims, 5 Drawing Sheets

STOWABLE EXERCISING APPARATUS

FIELD OF THE INVENTION

This invention relates to an exercising apparatus which can be hidden away under a bed. More particularly, the present invention relates to a stowable exercising apparatus which is secured to the frame of a bed and which can be stowed beneath the bed or positioned along the bed while in use.

DESCRIPTION OF THE PRIOR ART

There exists a requirement for a stowable exercising apparatus which will permit a user to complete a number of exercises while lying in bed, sitting on the side of the bed, standing by the bed or sitting on the floor.

Such a stowable exercising apparatus should be easily retractable and stowable and should also have enough structural integrity and strength to allow a user to complete a good range of exercising levels, i.e. easy or more difficult.

It is therefore an object of the present invention to provide a stowable exercising apparatus which can be hidden under a bed while being secured to the frame of the bed.

Yet another object of the present invention is to provide a stowable exercising apparatus which can be adjusted to any shape of bed frame.

Yet another object of the present invention is to provide a stowable exercising apparatus which includes an exercising assembly adapted to provide a variety of exercising routines to its user.

SUMMARY OF THE INVENTION

Accordingly, an aspect of the present invention is to provide a stowable exercising apparatus adapted to be mounted to the metal frame of a bed, comprising: means for securing said apparatus to said bed frame; means for moveably supporting said apparatus to said securing means; and exercising means mounted to said support means and adapted to be moveable from a vertical operating position along said bed to a horizontal resting position under said bed.

DRAWINGS

Particular embodiments of the invention will be understood in conjunction with the accompanying drawings in which.

DESCRIPTION OF THE PREFERRED EMBODIMENTS

Figure 1:
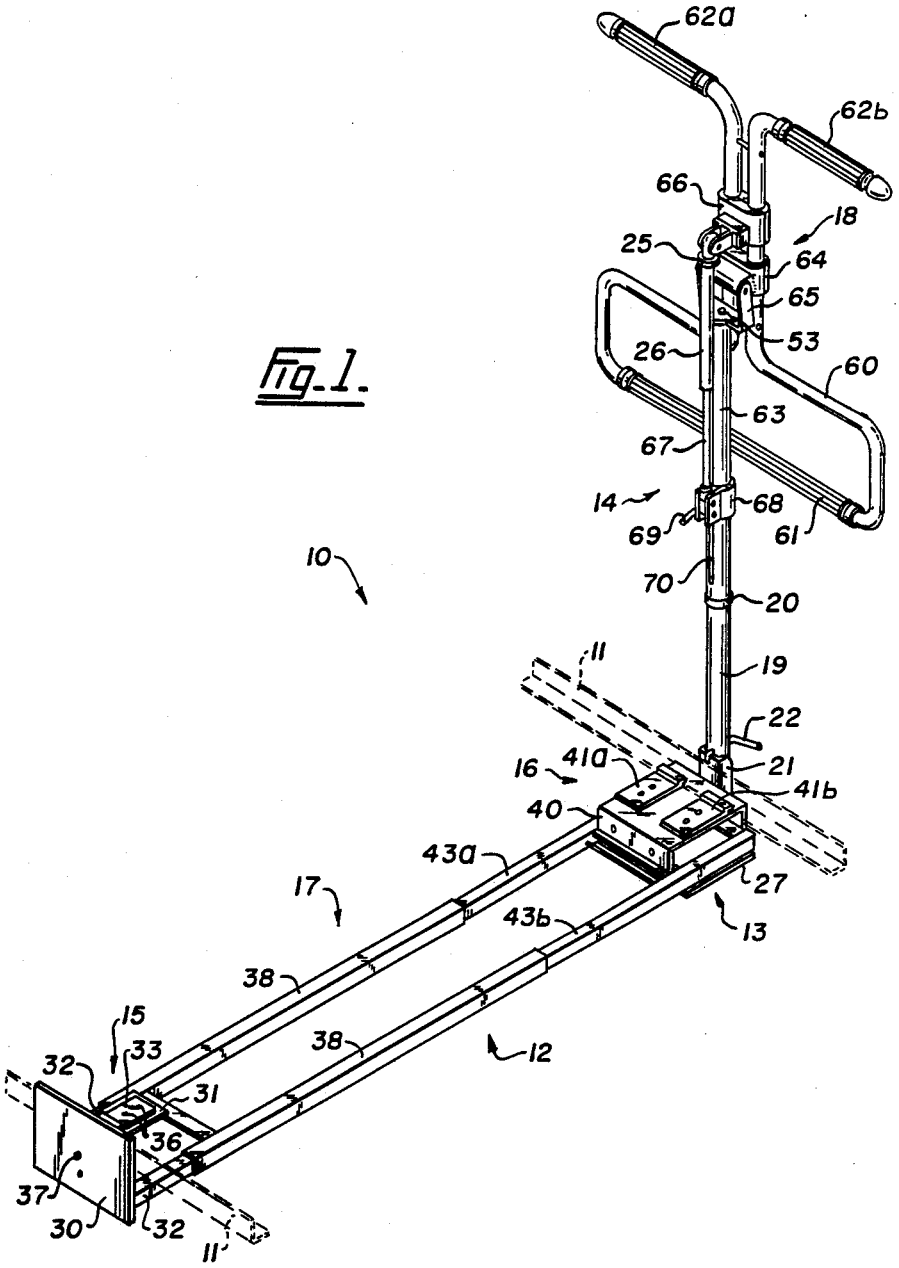
FIG. 1 is a perspective of the stowable exercising apparatus of the present invention.

Referring now to FIG. 1, we have shown generally at reference numeral 10 the stowable exercising apparatus of the present invention. The stowable exercising apparatus is adapted to be mounted and secured to a metal bed frame 11 commonly used to support a box spring mattress. Frame 11 has a spring L-shaped side members which are adjustable according to the various sizes of box springs.

The stowable exercising apparatus 10 is basically comprised of a mounting framework 12 adapted to secure the exercising apparatus to frame 11, a moveable support 13 adapted to be slid along framework 12 and on which is pivotably mounted exercising apparatus 14.

Mounting framework 12 comprises a first securing bracket 15 adapted to be mounted to a first side of frame 11, a second securing bracket 16 adapted to be mounted to a second side of frame 11 and an adjustable framework 17 connecting the first securing bracket 15 to the second securing bracket 16.

Exercising apparatus 14 is basically comprised of an exercising assembly 18 rotatably mounted on a support post 19 by means of a support ring 20. Support post 19 is pivotably mounted to base 13. Support post 19 is secured in the vertical operating position as depicted in FIG. 1 by means of a U-shaped receiving bracket 21 and locking lever 22.

Figure 2:
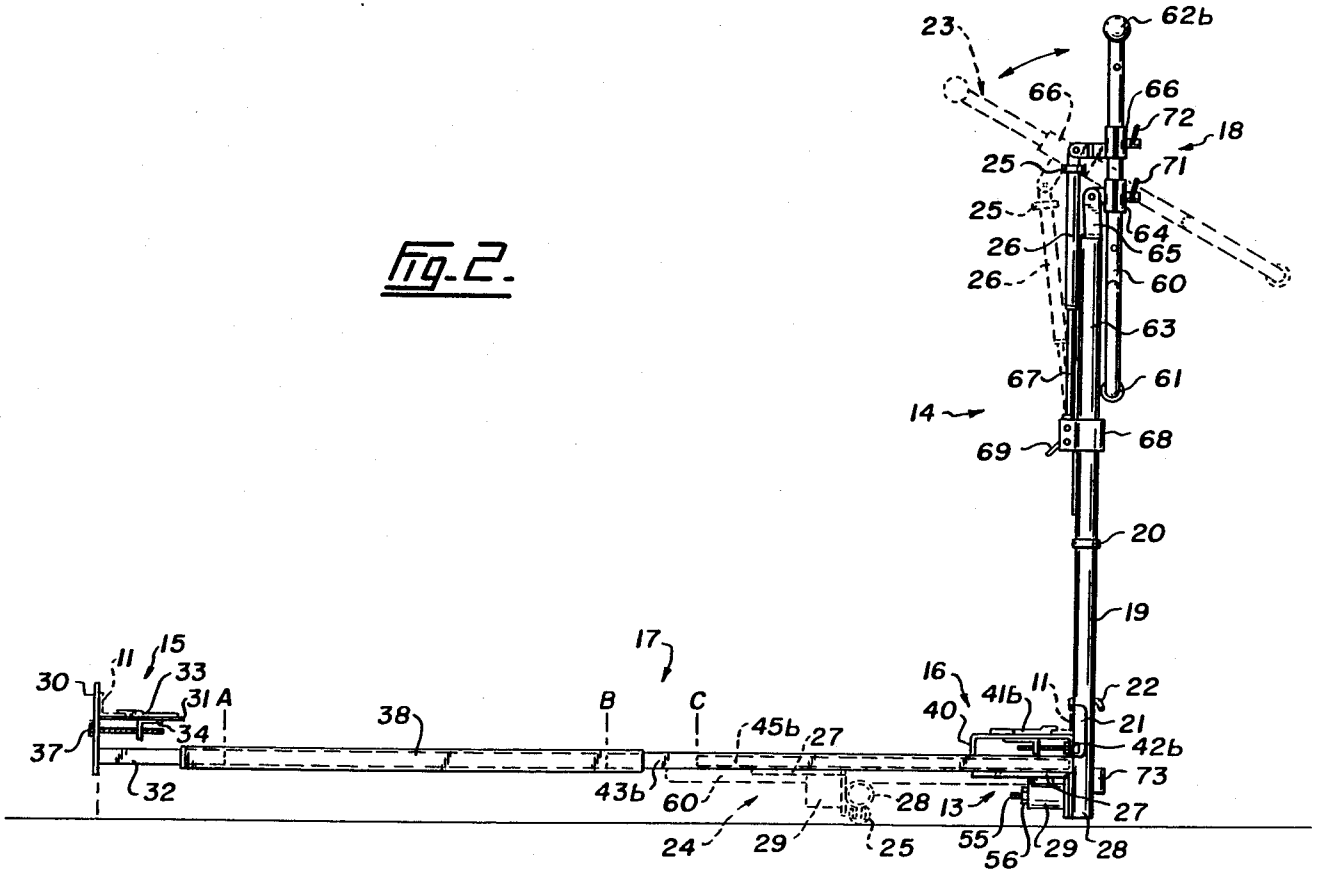
FIG. 2 is a side view thereof.

Referring now to FIG. 2, we have shown a side view of the stowable exercising apparatus of the present invention. Exercising assembly 18 can be actuated to the position shown by the broken lines that generally are shown at reference numeral 23. As will be described below, exercising assembly 18 offers a full range of adjustments and exercising functions.

The broken lines generally shown at reference numeral 24 depict the positioning of exercising apparatus 14 when placed in a horizontal position under the bed.

Figure 3:
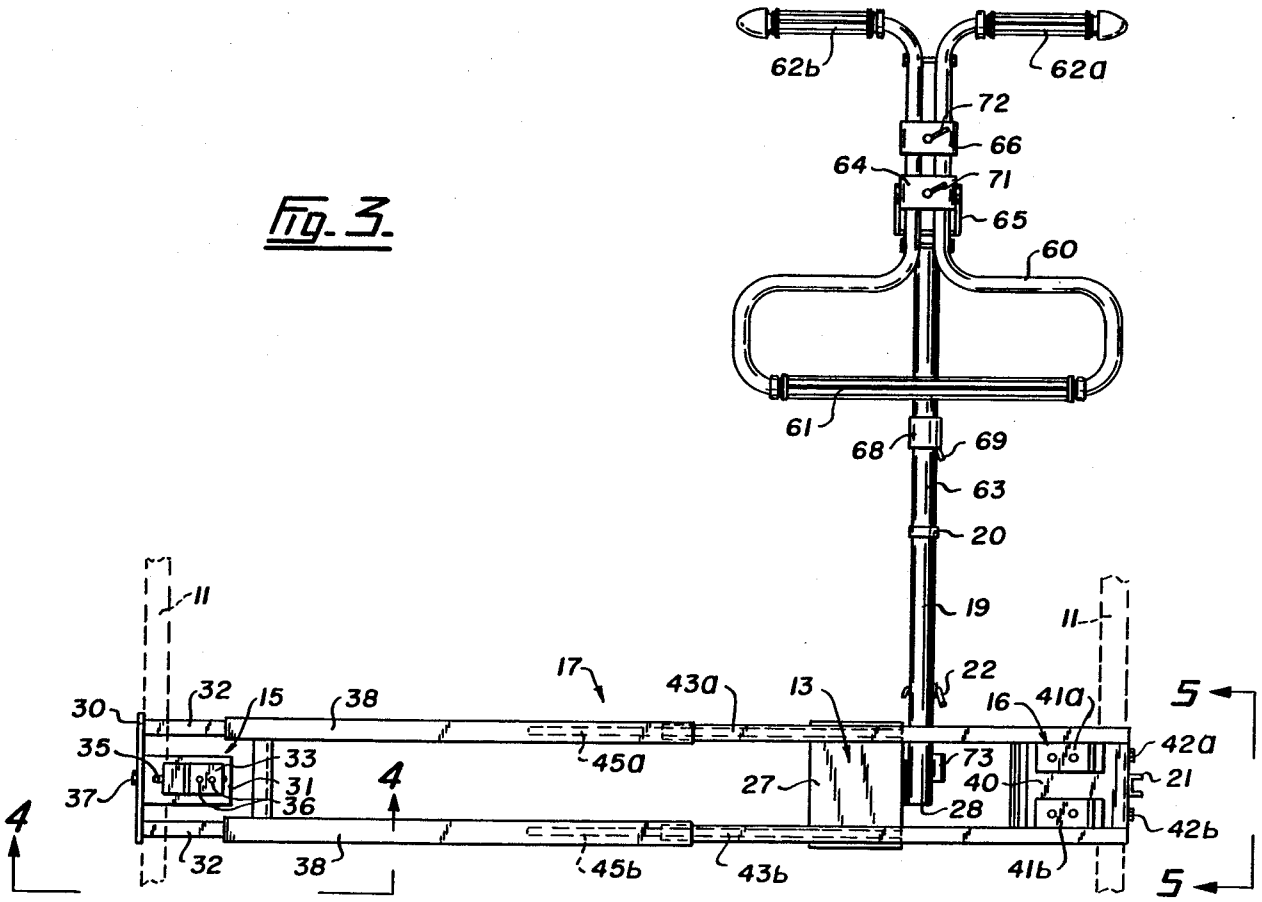
FIG. 3 is a top view of the exercising apparatus when stowed under a bed.

A top view of the exercising apparatus in its stowed position is shown in FIG. 3. Exercising assembly 18 has been pivoted such that support wheel 25 mounted on piston 26 of exercising member 18 can lie on the floor below the bed.

Moveable support 13 to which is pivotably attached support post 19, is comprised of a base 27 slidably mounted under framework 17. Bottom end 28 of support post 19 is pivotably mounted to base 27 by means of a cylindrical shaped sleeve 29 more clearly shown in FIG. 2.

Figure 4:
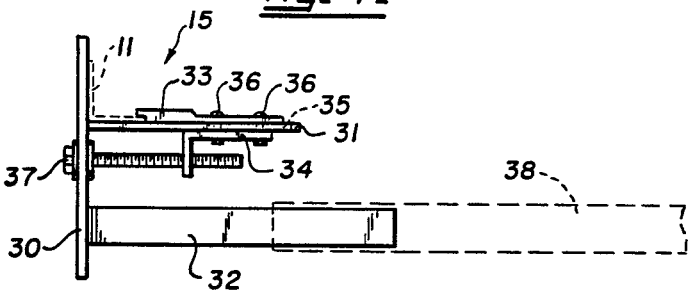
FIG. 4 is a side view of a securing bracket as shown at line 4—4 of FIG. 3.

Referring now to FIG. 4, we have shown a side view of securing bracket 15. The securing bracket is comprised of an end plate 30 to which is mounted perpendicular thereof a support plate 31 and a pair of tubes 32 having a square cross-section. Support plate 31 is provided with a slidably mounted securing plate 33 connected to an L-shaped clamp 34. Support plate 31 is provided with a slot 35 more clearly shown in FIG. 3 to allow securing plate 33 and L-shaped clamp 34 to move with respect to support plate 31. A pair of securing screws 36 can slide along slot 35 and secures bracket 33 to clamp 34. Securing bracket 15 is mounted and adjusted to fit frame 11 by rotating endless screw 37 mounted to end plate 30. Rotation of screw 37 will in turn move securing bracket 33 toward or away frame 11. Tubes 32 will form part of framework 17 when inserted into tubular extension 38 also having a square cross-section. The tubes of tubular extension 38 have interior dimensions larger than the exterior dimensions of tubes 32.

Figure 5:
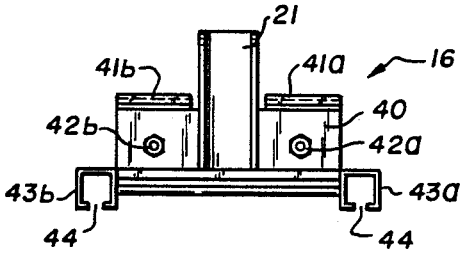
FIG. 5 is a front view of a second securing bracket as shown at line 5—5 of FIG. 3.

Referring now to FIG. 5, we have shown an end view of securing bracket 16. Securing bracket 16 is comprised of a box like mounting plate 40 on to which s mounted a pair adjustable securing plates 41*a* and 41*b*. Plates 41*a* and 41*b* are similar in design and in function to securing plate 33 shown in FIG. 4. Accordingly, plates 41*a* and 41*b* can be adjusted by means of endless screws 42*a* and 42*b* respectively. The U-shaped receiving bracket 21 is welded on mounting plate 40. Bracket 21 is adapted to receive the bottom end 28 of support post 19 when the exercising apparatus is in its vertical and operating position. A pair of hollow tubes 43*a* and 43*b* having a square cross-section are welded on each side of box-like mounting plate 40. A slot 44 under each tube extends along their entire length. Tubes 43*a* and 43*b* complete the adjustable framework along with tubular extension 38 and tubes 32. Tubes 32 extend into tubular extension 38 to the location shown at letter A, see FIG. 2. Tubes 43*a* and 43*b* extend into tubular extension 38 to the location shown at letter B. Framework 17 can therefore be adjusted according to the size of frame 11 by appropriately adjusting tubes 32 and 43 into tubular extension 38.

Figure 6A:
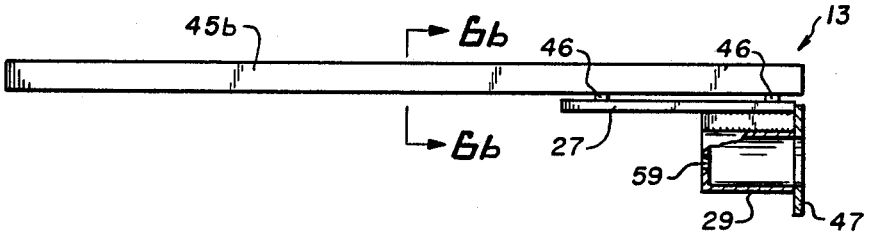
FIG. 6A is a side view of the moveable base on which is pivotably mounted the exercising assembly.
Figure 6B:
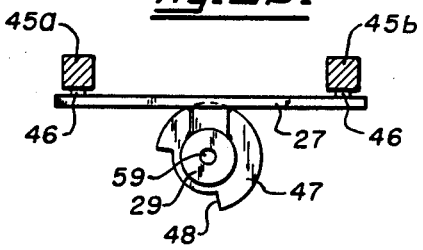
FIG. 6B is a rear view of the base as depicted by line 6B—6B of FIG. 6A.

Referring now to FIGS. 6A and 6B, we have shown a partially sectioned side view of the moveable support 13 and a front view thereof, respectively. As indicated earlier, moveable support 13 is comprised of a base plate 27 on to which mounted a pair of solid tubes 45*a* and 45*b* each tube having a square cross-section as depicted in FIG. 6B. Tubes 45*a* and 45*b* are adapted to be inserted into tubes 43*a* and 43*b* of framework 17 respectively. Solid tubes 45*a* and 45*b* are attached to base 27 by means of connecting points 46 which allow tubes 45*a* and 45*b* to be spaced apart from plate 27 and for insertion into tubes 43*a* and 43*b*. Connecting points 46 are, of course, of an appropriate size such that when tubes 45*a* and 45*b* are inserted into tubes 43*a* and 43*b*, they may slide along slot 44 of tubes 43*a* and 43*b*.

When exercising apparatus 14 is in its vertical or operating position such as shown in FIGS. 1 and 2, solid tubes 45*a* and 45*b* extend to the position shown by letter C. When exercising apparatus 14 is in its horizontal position stowed below the bed, such as shown in FIG. 3, tubes 45 extend into tubes 43 and tubular extension 38 to the position depicted by letter C.

Bottom end 28 of support post 19 is pivotably attached to moveable support 13 by means of hollow cylindrical sleeve 29. Sleeve 29 is provided with an outer circular flange 47 a portion of which has been cut out. Portion 48 represents approximately one-fourth of the circumference of flange 47. This cut-out portion is used in conjunction with a stopping pin or nut and allows the exercising apparatus to be pivoted from a vertical and operating position to a horizontal and resting position.

Figure 7A:
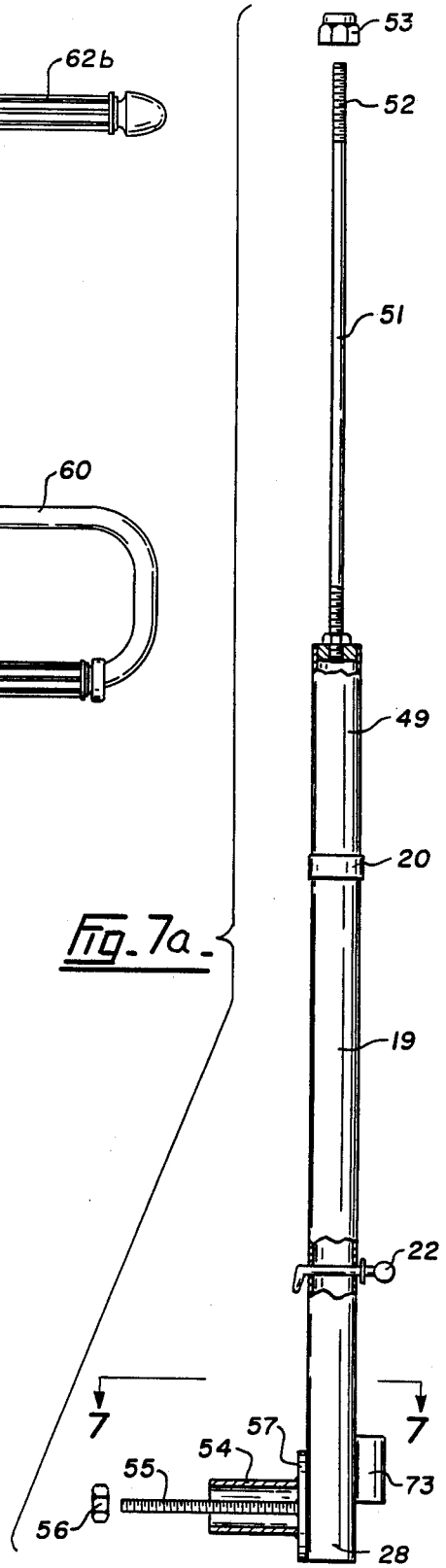
FIG. 7A is a partially sectioned view of the support post on which is mounted the exercising member.
Figure 7B:
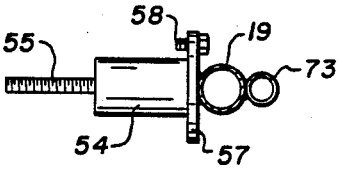
FIG. 7B is a top view, as depicted by line 7—7 of FIG. 7A, of the pivot by which the support post of FIG. 7A is mounted to the base shown in FIG. 6A.

Referring now to FIGS. 7A and 7B, we have shown a partially sectioned side view of support post 19. Support post 19 is comprised of a hollow cylinder on which is mounted a support ring 20 adapted to rotably receive exercising assembly 18. A rod 51 is threadably mounted to the upper end of hollow cylinder 49. Rod 51 includes a threaded portion 52 adpated to receive a securing nut 53. Rod 51 will help secure exercising assembly 18 on support ring 20. At its bottom end 28, support post 19 is provided with a tubular insert 54 with a centrally located rod 55 threaded along its length and adapted to receive a securing nut 56. Insert 54 is adapted to be received by cylindrical sleeve 29 of moveable support 13. Insert 54 is also provided with a circular flange 57 adapted to mate with flange 47 of moveable support 13. Flange 57 is provided with a stopping pin or nut 58, see FIG. 7*b*, adapted to travel along cut-out portion 48 of flange 47. When insert 54 is received by sleeve 29, rod 55 will pass through aperture 59.

Locking lever 22 is used to lock exercising apparatus 14 in the vertical operating position, by securing support post 19 to the U-shaped receiving bracket 21.

Figure 8:
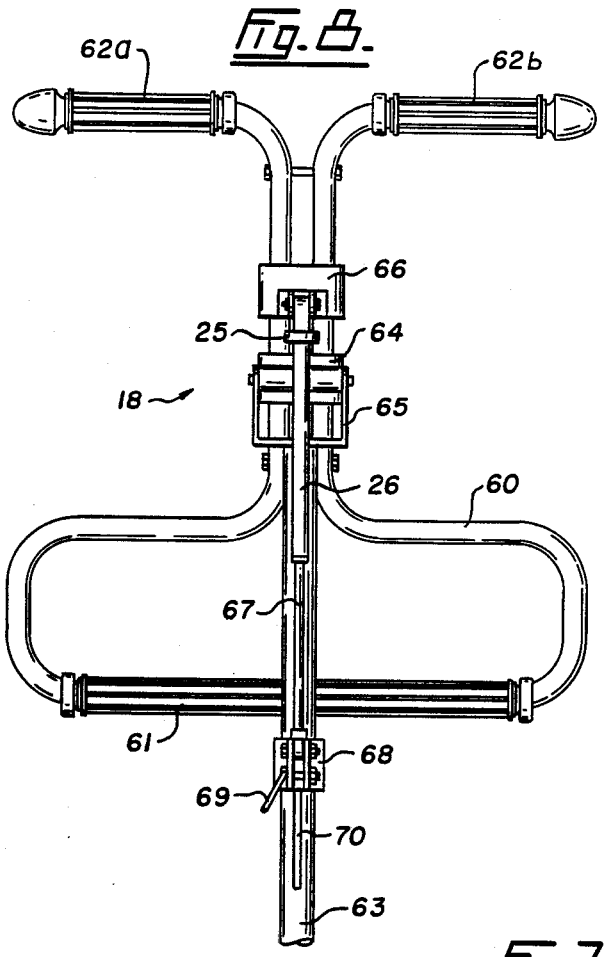
FIG. 8 is a front view of the exercising member of the present invention.

Referring now to FIG. 8, we have shown a front view of the exercising assembly 18. The exercising assembly is comprised of an actuating bar 60 having at one end a single elongated, rotatable handle 61 and at its other end a pair of rotatably mounted handles 62*a* and 62*b*. Actuating bar 60 is pivotably mounted on a support shaft 63 by means of a first tightening clamp 64 more clearly shown in FIG. 1 and FIG. 3. Clamp 64 is pivotably secured to a U-shaped bracket 65 mounted on shaft 63. Rod 51 shown in FIG. 7A is inserted into shaft 63 and secured thereto by means of nut 53 located on bracket 65.

A second tightening clamp 66 pivotably connects actuating bar 60 to a piston 26. Piston rod 67 is similarly pivotably connected to an adjustable securing clamp 68. Clamp 68 is secured to shaft 63 and can be moved upwardly and downwardly shaft 63 by untightening lever 69. Shaft 63 is provided with a key 70 which keeps clamp 68 from turning with respect to shaft 63. Clamps 64 and 66 can be moved along actuating bar 60 when these have been untightened by means of levers 71 and 72 respectively shown in FIG. 3. Clamps 64, 66 and 68 allow for a multiplicity of movement of exercising assembly 18. For example, by lowering clamp 68, actuating bar 60 can be pivoted from a vertical orientation as shown in FIG. 8 to a horizontal orientation. Also, by moving clamps 66 along actuating bar 60, the amount of torque required to compress piston 26 can be varied accordingly.

In operation, the exercising apparatus of FIG. 1 can be stowed to the position shown in FIG. 3, by rotating locking lever 22 to unlock support post 19 from U-shaped clamp 21. Moveable support 13 is then slid away from the bed in order that the lower end of support post 19 can clear the side flanges of bracket 21. The exercising assembly 18 can then be pivoted to a horizontal position by allowing support post 19 and exercising assembly 18 to lie against the floor. In order to ease the stowing of the assembly, the exercising assembly should be pivoted in order that piston 26 can lie facing the floor and thus permit support wheel 25 to be supported thereon. Once on the floor, the entire assembly including moveable support 13 can be pushed such that exercising assembly 18 lies fully under the bed frame 11, as shown in FIG. 3. The exercising assembly 18 can be erected in its upright or vertical operating position by completing the aforementioned steps in reverse. An L or hook shaped bar (not shown) can be inserted into tube 73 to make it easier for a user to pull the entire assembly from under the bed.

The embodiments of the invention in which an exclusive property or privilege is claimed are defined as follows:

1. A stowable exercising apparatus adapted to be mounted to the frame of a bed, comprising:

means for securing said apparatus to said bed frame comprising a pair of adjustable securing brackets adapted to be secured at opposite sides of said bed frame, said securing brackets being connected by means of an adjustable framework extending from one bracket to the other;

supporting means for supporting said apparatus on said adjustable framework and adapted for slidable movment on said adjustable framework; and exercising means mounted to said supporting means and adapted to be movable from a vertical operating position along said be to a horizontal resting position under said bed wherein said supporting means comprises a base slidably mounted on said framework and has pivoting means for connecting said exercise means to said base to permit said exercising means to be pivoted to a horizontal position and then slidably moved to said resting position.

2. An apparatus as defined in claim 1 wherein said exercising means comprises an exercising assembly rotatably mounted to a support post, said post being pivotable mounted to said base at said pivoting means.

3. An apparatus as defined in claim 2 wherein said framework comprises a pair of hollow tubular members extending from a first securing bracket to a second securing bracket, each of said hollow tubular members having a slot along its length to allow for movement of said base along said hollow tubular members.

4. An apparatus as defined in claim 3 wherein said tubular members are telescopic to allow said framework to be adjusted according to the size of the bed frame.

5. An apparatus as defined in claim 3 wherein said base is slidably mounted below said framework by means of a corresponding pair of tubes mounted to said base and adapted to be received by said tubular members, said tubes having an exterior diameter smaller than the interior diameter of said tubular members, said pair of tubes being secured to said base by connecting means adapted to slide along said slot.

6. An apparatus as defined in claim 5 wherein said pivoting means comprises a cylindrical shaped sleeve attached to said base and adapted to receive a corresponding cylindrical shaped attachment connected to said post and adapted to be received by said sleeve, said attachment having an exterior diameter smaller in size than the interior diameter of said sleeve.

7. An apparatus as defined in claim 6 wherein said exercising assembly is comprised of an actuating bar having at each end rotatably mounted handles, said actuating bar being pivotably mounted about said support post, said actuating bar being connected to a piston assembly thereby provide a resistance against the movement of said actuating bar.

* * * * *